United States Patent [19]

VanderVaart

[11] 4,420,034

[45] Dec. 13, 1983

[54] HEAT-AUGMENTED HEAT EXCHANGER

[75] Inventor: Gerry VanderVaart, Niagara Falls, Canada

[73] Assignee: Kool-Fire Limited, Niagara Falls, Canada

[21] Appl. No.: 259,356

[22] Filed: Apr. 30, 1981

Related U.S. Application Data

[60] Division of Ser. No. 87,154, Oct. 22, 1979, Pat. No. 4,311,192, which is a continuation-in-part of Ser. No. 54,647, Jul. 3, 1979, Pat. No. 4,311,191.

[51] Int. Cl.[3] ..... F25B 29/00

[52] U.S. Cl. ..... 165/29; 62/238.7; 237/2 B

[58] Field of Search ..... 165/29; 62/238.6, 238.7, 62/324; 237/2 B

[56] References Cited

U.S. PATENT DOCUMENTS

| | | | |
|---|---|---|---|
| 3,135,317 | 6/1964 | Goettl | 165/29 |
| 3,157,227 | 11/1964 | Palmer | 165/29 |
| 3,627,031 | 12/1971 | Ware | 165/22 |
| 3,831,670 | 8/1974 | Mullings | 165/122 |
| 4,012,920 | 3/1977 | Kirschbaum | 62/238.7 |
| 4,090,492 | 5/1978 | Simmons | 165/DIG. 2 |
| 4,112,705 | 9/1978 | Sisk et al. | 165/29 |
| 4,141,490 | 2/1979 | Franchina | 62/238.6 |
| 4,187,687 | 2/1980 | Savage | 237/2 B |
| 4,256,475 | 3/1981 | Schafer | 62/238.7 |

*Primary Examiner*—William R. Cline
*Assistant Examiner*—John M. Kramer
*Attorney, Agent, or Firm*—Diller, Ramik & Wight

[57] ABSTRACT

A heating system of the heat pump type is disclosed in which the outside coil, employed to reject heat in air conditioning mode or to absorb heat in heating mode, is supplied with heat independently of that provided by ambient air when the efficiency of the system falls off due to low ambient air temperature. The amount of heat thus supplied is controlled to increase the efficiency of the system sufficiently to produce a significant net decrease in operating cost. In a conventional system, the outside air coil-cooling fan is turned off and augmenting heat is supplied to the coil when the ambient air temperature is moderate (e.g., 32°-38° F.) for the system, and the augmenting heat is supplied at a rate which is at least sufficient to restore the efficiency of the system to that inherent with a much higher ambient air temperature. At the same time, the outside coil temperature is monitored and the augmenting heat is temporarily discontinued when the coil temperature reaches a selected value (e.g., 70° F.).

4 Claims, 5 Drawing Figures

HEAT-AUGMENTED HEAT EXCHANGER

CROSS REFERENCE TO RELATED APPLICATION

This application is a division of Ser. No. 87,154 filed on Oct. 22, 1979, now U.S. Pat. No. 4,311,192, which is a continuation-in-part of Ser. No. 54,647 filed July 3, 1979, now U.S. Pat. No. 4,311,191.

BACKGROUND AND BRIEF SUMMARY OF INVENTION

This invention is directed to the problems of low efficiency of heat pump systems due to low ambient temperature.

It is well known that a heat pump, in heating mode, will reach a "balance point" at some value of ambient air temperature. Simply put, this point is reached when the heat pump system requires supplemental heat in order to maintain the inside air temperature demanded by the thermostat. Some systems have been employed in which the heat pump is simply switched off at this "balance point" with all heat thereafter being supplied by a more conventional heating system such as a furnace. Still others have employed control systems in which the heat pump system is still utilized down to its limit of ambient temperature (e.g., 10° F.) while increasingly supplementing its heat output, below the "balance point," by more conventional means such as electrical resistance heaters, etc.

Whereas such systems have also employed defrosting heaters for the outside coil (essential to avoid "blinding" of the coil and to retain good heat transfer with the circulated ambient air), it has not been recognized that the efficiency of a heat pump system may be artifically restored under low ambient air temperatures to a sufficiently high value, with minimal heat imput, as to justify, economically, this sort of "bootstrapping."

Thus, in a conventional system, when the heat available for extraction from ambient air has reached such a low value as to produce relatively low efficiency for the system, heat is applied directly to the outside coil in such limited quantity as (1) artificially restores the efficiency to a much higher value and (2) does so with a net decrease in operating cost.

IN THE DRAWINGS

Figure 2:
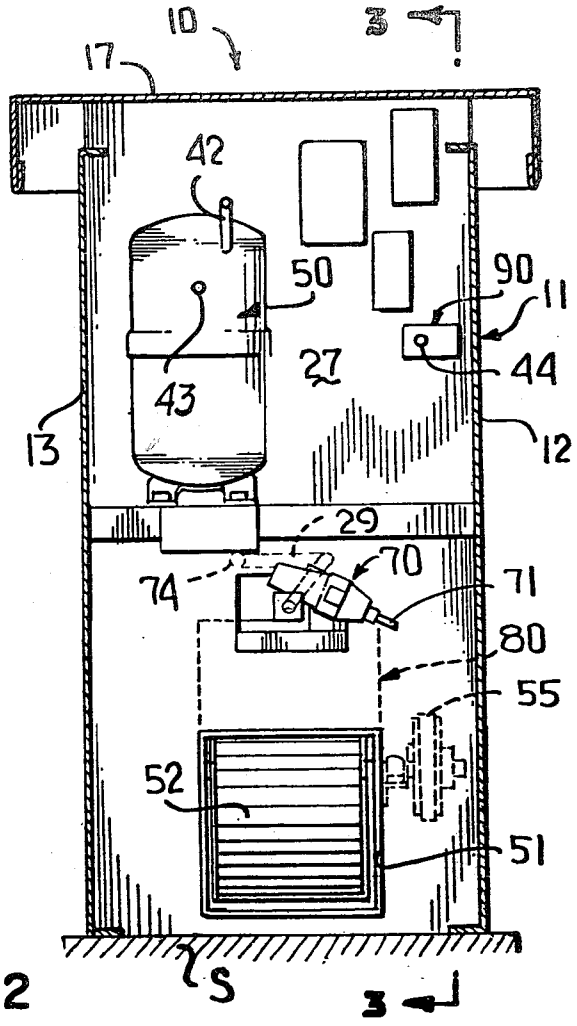
FIG. 2 is a sectional view taken generally along line 2—2 of FIG. 1 and illustrates additional details of the heat exchanger including a heat source, such as a natural gas burner, for augmenting the heat absorbed from ambient air by the A-coil.

Reference is now made to FIGS. 1 through 4 of the drawings in which a novel heat exchanger or heat-augmented heat pump is generally designated by the reference numeral 10 and includes a housing 11 defined by a front wall 12, a rear wall 13, end walls 14, 15, a bottom wall 16 seated upon a concrete slab S, and a top wall or cover 17. The cover 17 is preferably hinged (not shown) to an upper edge portion of the rear wall 13 so that ample access to the interior of the housing 11 is provided from above when the cover 17 is in its open (not shown) position. Likewise, the end walls 14, 15 are removably secured by sheet metal screws (not shown) to the walls 12, 13 so that the end walls 14, 15 can be readily removed, thus, providing ample access to interior components of the heat exchanger 10.

The height of the walls 12, 13 is less than the total height of the end walls 14, 15, as is readily apparent in FIG. 1, and the end walls 14, 15 are relieved at 20, 21, respectively, as well as being provided with baffled vents or openings 22, 23, respectively (FIGS. 1 and 3) in order that air might readily circulate through the housing 11 in a manner to be described more fully hereinafter.

Figure 3:
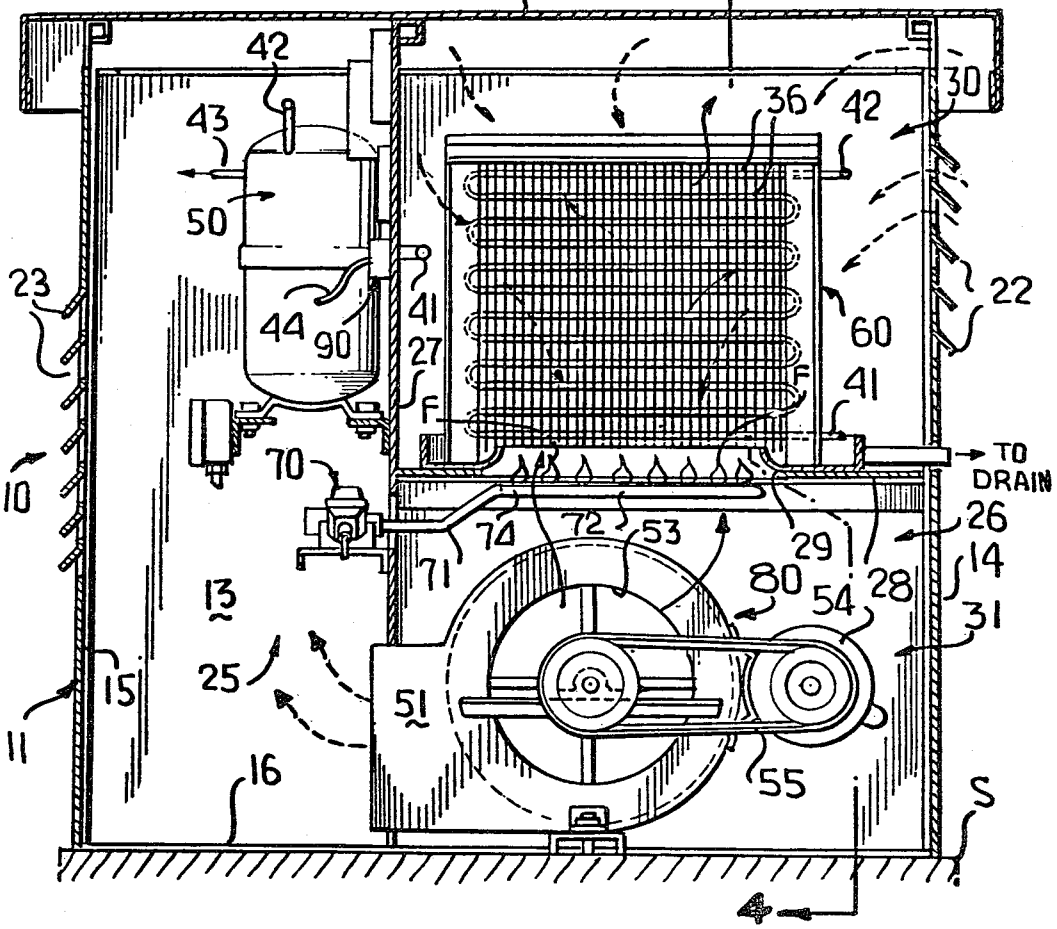
FIG. 3 is a longitudinal sectional view taken generally along line 3—3 of FIG. 2 and illustrates details of the heat exchanger housing including the location of the source of heat adjacent bottom portions of the legs of the A-coil.

The housing 11 is also separated into a pair of chamber means or chambers 25, 26 by a vertical partition or wall 27 while a horizontal partition or wall 28 having a central opening 29 (FIG. 3) separates the chamber 26 into an upper chamber portion 30 and a lower chamber portion 31 (FIG. 3). The construction of the housing 11 and particularly the manner in which the same has been partitioned results in highly efficient air flow as well as increased noise damping characteristics, as will be more evident hereinafter. Furthermore, all of the electrical components of the electrical system (FIG. 5) are located in the chamber 25 whereat they will be unaffected by moisture, condensation, or the like which will occur in the upper chamber portion 30 of the chamber 26. The exact location of the various components of the electrical circuit 40 in the chamber 25 is of no particular importance insofar as the present invention is concerned and are thus not illustrated in any of FIGS. 1 through 4 of the drawings.

The major components of the heat exchanger 10 of the invention include compressor means 50, and A-coil 60, and means 70 for providing a heat source to augment the temperature of outside ambient air. In addition to the latter-noted major components, the heat exchanger includes a blower 80 and a reversing/expansion valve 90.

Figure 1:
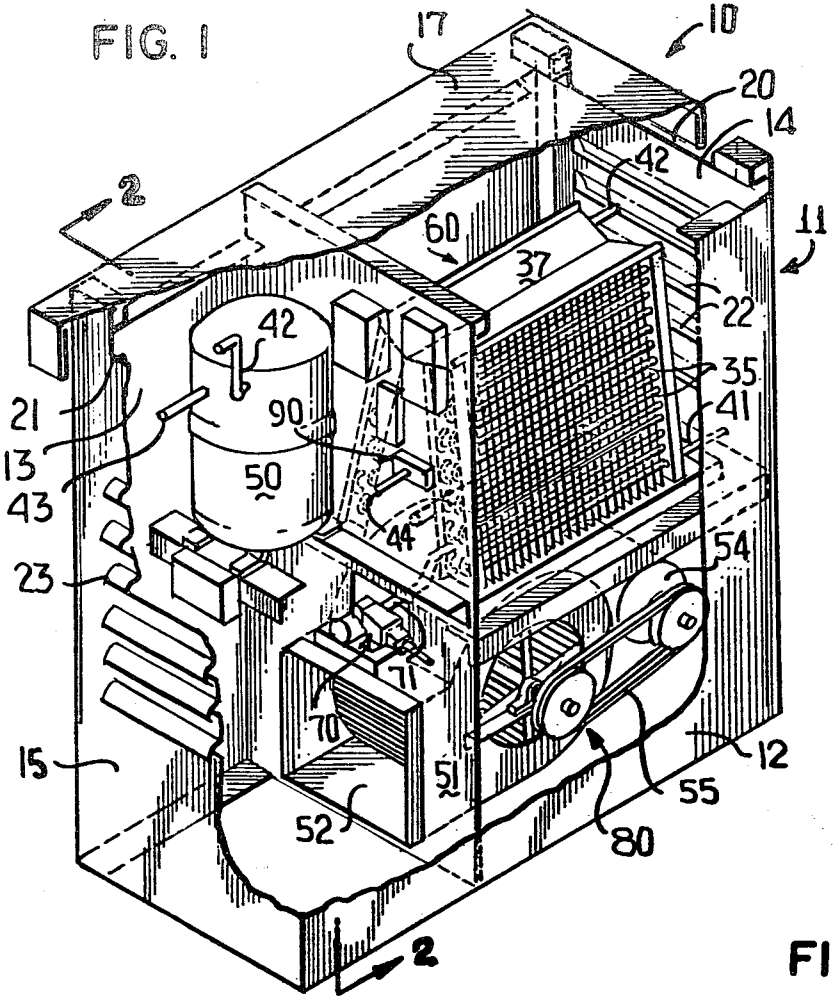
FIG. 1 is a fragmentary perspective view of a novel heat exchanger of the present invention and illustrates an A-coil, a blower, an associated compressor and an associated housing.
Figure 4:
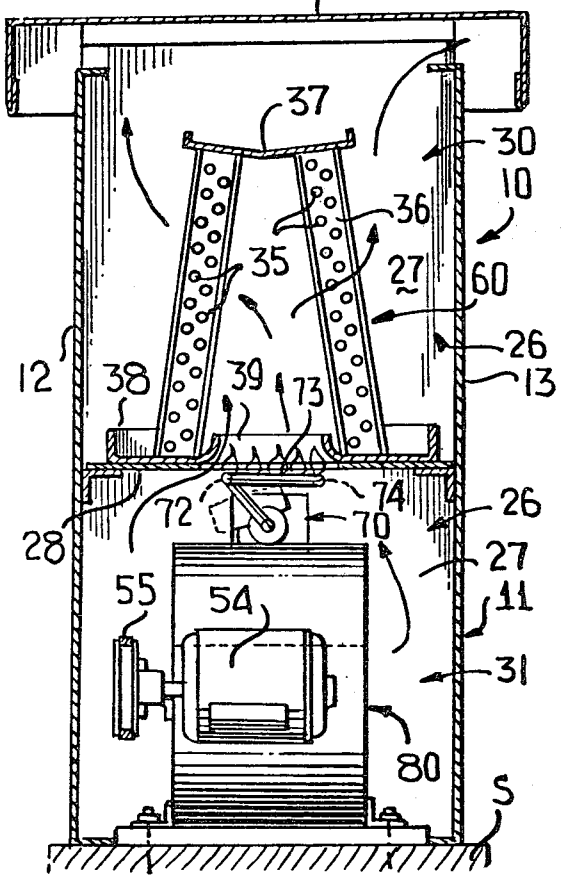
FIG. 4 is a sectional view taken generally along lines 4—4 of FIG. 3 and illustrates the manner in which hot air rises within and through the absorber fins and about the coils of the A-coil during the heat-augmented mode of operation of the heat exchanger.

Reference is made specifically to FIGS. 1, 3 and 4 of the drawings wherein the A-coil 60 is fully illustrated and is a conventional off-the-shelf item which in transverse cross-section is generally of an inverted V-shaped configuration (FIG. 4) defined by a pair of interconnected coils 35 which are coiled through metallic heat-conductive fins 36. An upper end portion (unnumbered) of the A-coil 60 is covered by a removable metallic plate 37 while bottom end portions (unnumbered) of the A-coil 60 rest upon a generally annular condensation collecting pan 38 having a central elongated opening 39 disposed adjacent the opening 29 of the horizontal partition or wall 28 (FIGS. 3 and 4). The coils 35 of the A-coil 60 include an inlet/output 41 (FIG. 3) and a bottom of each leg of the A-coil 60 and an inlet/outlet 42 at the top of each leg of the A-coil. The expression "inlet/outlet" has been utilized herein simply to indicate that, depending upon the particular mode of operation of the heat exchanger, refrigerant will flow through the coils 35 in one direction at which the refrigerant will exit from the conduit 41 while in another mode, the refrigerant may enter the conduit 41, and the same is true of the conduit 42. Hence, the expression "inlet/outlet" merely refers to the direction of flow of the refrigerant, either in its liquid or vapor phase, with respect to the particular mode of operation of the heat exchanger 10, as will be more fully apparent hereinafter.

The inlet/outlet or conduit 42 is connected to the compressor 50 (FIG. 3) and a conduit 43 from the compressor 50 is connected to a heat exchanger within a building, such as a home, apartment, or the like which is to be heated or cooled. The "interior" heat exchanger or a similar heat utilizing device is of a conventional construction, thus is not illustrated but may simply be a coil such as the A-coil 60, though not necessarily of the same configuration. The conventional utilizing coil need only have air blown through it so that during the cooling mode, cold liquid refrigerant will absorb heat fom the interior air resulting in a decrease in interior air temperature or alternatively when high temperature refrigerant vapor is passed through the utilization coil, the interior air passing through the coil absorbs the warm air and is thereby warmed in the heating mode.

The interior or utilizer coil is connected by an inlet/-outlet conduit 44 (FIG. 3) to the expansion/reversing valve 90 and the latter is connected to the inlet/outlet conduit 41. Thus, the flow circuit for the refrigerant, be it in its liquid, vapor or liquid/vapor phase is from the A-coil 60 through the inlet-outlet conduit 42 to the compressor 50 thence through the conduit 43 to the interior utilization heat exchanger followed by the inlet/outlet conduit 44, the reversing/expansion valve 90 and back to the bottom of the A-coil 60 through the inlet/outlet conduit 41.

The blower 80 includes a housing 51 having an outlet 52 opening into the chamber 25 and an inlet 53 opening into the chamber portion 26. The fan is driven by a conventional motor 54 through conventional pulleys, a pulley belt, and shafts, all collectively designated by the reference numeral 55 (FIG. 1). The motor 54 is energized during the operation of the heat exchanger 10 in its conventional cooling mode and its conventional heating mode, but not during its heat-augmenting mode in which air rises through the A-coil 60 by natural convection currents, as indicated by the headed, unnumbered arrows in FIGS. 3 and 4, and as will be described more fully hereinafter.

The heat source 70 for augmenting the ambient outside air temperature is illustrated as a natural gas burner 70 which includes an outlet burner or conduit 71 (FIG. 3) having a first leg 72 which runs along one side of the opening 39 (FIG. 4), a leg 73 transverse thereto (FIG. 4), and a return leg 74 (FIG. 4) which terminates in a blind end (not shown) adjacent the left-hand edge of the slot 39, as viewed in FIG. 3. The legs 72 through 74 of the burner or conduit 71 have a plurality of openings which emit flames F when the natural gas is ignited by a conventional spark or like igniter.

The operation of the heat exchanger 10 will now be described with reference first to the conventional cooling and heating modes of operation, followed by the novel heat-augmenting mode of operation thereof.

HEATING MODE

In the heating mode of operation of the heat exchanger 10, the heat-exchange medium (a cold refrigerant such as Freon) first flows under the operation of the compressor 50 into the inlet conduit 41 at the bottom of the A-coil 60 and progressively absorbs heat from ambient air which is drawn into the upper housing portion 30, through the coils, into the inlet 53 of the blower, and outwardly from the outlet 52 of the pump into the chamber 25 during the energization of the pump with the latter-noted air flow being indicated by the dashed, unnumbered headed arrows in FIG. 3. At this point, the heat source 70 is totally unoperational and, therefore, the heat-exchange medium, as it moves through the coils 35 in an upward direction, absorbs heat only from ambient air which is drawn through the A-coil 60 in the manner just described. The progressive increase in temperature of the heat-exchange medium transforms the same into its low pressure vapor phase which is conducted via the outlet conduit 42 to the compressor 50 which further increases the pressure, thus the temperature, and the hot vapor phase of the refrigerant then flows through the conduit 43 to the interior heat exchanger (heat-exchange coil) through which air is blown absorbing the heat of the vapor phase refrigerant, heating the interior and, of course, progressively cooling the refrigerant which is returned to the reversing-/expansion valve 90 through the conduit 41 which in turn returns the now low pressure cold vapor phase and/or liquid phase of the heat-exchange medium to the bottom of the A-coil 60 whereafter the cycle is continuously repeated.

COOLING MODE

For cooling purposes, the expansion/reversing valve 90 simply reverses the direction of refrigerant flow and the latter is controlled, for example, in a conventional manner by the circuitry 40 including the thermostat thereof which can be set, as desired. In this manner, high pressure hot vapor refrigerant when pumped through the A-coil gives off its heat to the air flowing therethrough under the influence of the blower 80, and the high pressure cool vapor or liquid phase is transformed by the reversing/expansion valve to a lower pressure gas or liquid phase which when passed through the utilization coil in the building picks up or absorbs the heat blown through the utilization coils thereby cooling the room or building air after which the now lower pressure vapor phase is returned from the utilization device to the compressor.

HEAT-AUGMENTING MODE

In this mode of operation of the heat exchanger 10, the blower 80 is inoperative, and the operation and/or flow of the refrigerant, both as to its liquid and/or vapor phase, is identical to that heretofore described in the "heating mode" of the heat exchanger 10. However, it is to be understood that in the heat-augmenting mode of operation of the heat exchanger 10, ambient outside temperature is relatively low as, for example, 32° F. or below. The temperature sensor associated with the gas burner assembly of the electrical circuitry 40 of FIG. 5 senses a predetermined temperature (32° F.) and in response thereto (1) the blower 80 is de-energized to terminate the heating mode of operation, and (2) the heat source 70 or gas burner assembly is energized by igniting the gas resulting in the hot flames F which under natural convection, currents rise upwardly through the A-coil 60, as indicated by the headed unnumbered arrows in FIG. 3. The flames F are extremely small but are spread out substantially evenly across the bottom of the A-coil 60, as is most readily apparent in FIGS. 3 and 4 of the drawings. As the heat from the flames F rises, it first impinges under its maximum temperature against the coldest (bottom) coils and the liquid heat exchange medium therein with, of course, the refrigerant flowing through the coils 35 in a direction from the bottom of both of the legs of the A-coil 60 to the tops thereof. Due to this relationship, deterioration of the bottom coils 35 and the lower fins 36 is virtually precluded, and because there is the greatest temperature differential between the refrigerant in the lowermost coil and the flames F, a major amount of heat absorption takes place along the bottom of the A-coil 60 and progressively lessens in an upward direction since the liquid cool refrigerant progressively warms as it rises in the coils 35 until it is transformed into its vapor phase. Essentially, there is almost total heat absorption at the time that the vapor phase of the refrigerant exits the conduit 42 of the A-coil 60 and an essentially heat-free gas (from the flames F) escapes to atmosphere so that the burning process approaches 100 percent. It is to be noted that the flames F do not generate the totality of the heat necessary to transform the refrigerant from its liquid phase to its vapor phase as it passes upwardly through the coils 35 of the A-coil 60, but rather augments or adds to the heat which the refrigerant can absorb from the ambient air, even though the latter is relatively cold (32° F., again merely exemplary). Thus, it is totally immaterial to the operation of the heat exchanger 10 as to what might be the ambient air temperature, be it 32° F. or −24° F., etc. All that the heat exchanger "knows" is that there is sufficient heat available from the flames F, which when added to that of the ambient air temperature results in a high temperature differential between the total heat input and the temperature of the refrigerant resulting in a hot gaseous or vapor phase exiting the A-coil 60 through the outlet conduit 42 for suitable in-house heating purposes by the conventional utilization heat exchangers heretofore noted. Thus, the compressor 50 can utilize in an extremely efficient manner the relatively highly heated low pressure vapor phase of the refrigerant which would be totally impossible in the absence of the additive heat provided by the heat source 7. Efficiency is further increased by constructing the A-coil 60 of a size approximately twice that of the utilization coil within the building to be heated so that essentially all of the heat induced by the flames F in the refrigerant passing through the coils 35 of the A-coil 60 is absorbed, again along with absorbing the heat of the ambient air itself, resulting in extremly efficient heat-transfer and corresponding low operating costs as well as interior building comfort by virtue of high volume/low temperature (approximately 105° F.) interior hot air flow. An example of the latter is evidenced by the following table which represents the total costs of heating a three-bedroom brick bungalow utilizing the heat-augmenting mode of operation of the heat exchanger 10 in Niagara Falls, Ontario, Canada, from Oct. 1, 1978, through Apr. 15, 1979. The home is occupied by five persons and the daytime temperature was maintained at 72° F. with the nighttime temperature being 68° F. The basement of this bungalow was maintained at an average temperature of 65° F. at all times.

| Month | Average Outside Temp. of | Energy Cost Elect. | Gas | Total |
|---|---|---|---|---|
| October | 47 | $4.25 | — | $4.25 |
| November | 37 | $11.57 | $8.88 | $20.45 |
| December | 27 | $16.31 | $19.94 | $36.25 |
| January | 19 | $19.73 | $25.18 | $44.91 |
| February | 12 | $18.09 | $23.71 | $41.80 |
| March | 34 | $11.30 | $13.23 | $24.53 |
| April 1–15 | 32 | $5.73 | $6.88 | $12.61 |
| Total Cost for Period | | $86.98 | $97.82 | $184.80 |

It is believed that the latter-noted recordation of an actual working embodiment of this invention indicates quite emphatically the extremely efficient and low-cost nature of the present invention and, of course, the ability of the invention to operate under outside ambient air temperature conditions which wound render other heat pumps inoperative or require utilization of supplementary heat sources, such as electric heating coils which are installed in hot air ducts as practiced by such well-known heat pump manufacturers as York, Lennox, etc.

Another oustanding indication of the efficiency of the present invention is that in another home heated by a conventional gas furnace, the charges for the gas for the month of January, 1979 was $122.71 (Canadian). The same home was converted by the installation of the heat exchanger 10 of this invention and its operation for the same period of time (one month) in the heat-augmenting mode resulted in a gas bill of $43.80 (Canadian), and the latter charge was for the month of February which recorded the lowest temperatures not only for the year but since records have been kept.

Other and equally important practical results are obtained by the present invention as, for example, the desirable utilization of condensation, as the same naturally occurs when the heat of the flames F contact the relatively colder coils 35 and fins 36 of the A-coil 60. The condensation thus formed results in a film of water over the entirety of the coils 35 and the fins 36 and, thus, the heat of the flames F is not directly transferred onto the metal coils 35 and the fins 36 but rather onto the film of water which, in turn, protects the components of the A-coil 60. In other words, the film of condensation or water upon the exterior surfaces of the A-coil 60 serves as a heat exchanger and protects the A-coil 60 from heat damage. Secondly, after a summer's running of the heat exchanger 10 in the cooling mode dust collects on the A-coil and this is cleaned throughout the winter during the heat-augmenting mode by the condensation constantly running down the coils 35 and fins 36 consequently resulting in a repetitious self-cleaning cycle of the heat exchanger 10 through repetitive seasons of use.

The heat exchanger 10 does not require a defrost cycle of any type which is virtually commonplace throughout the heat pump industry.

The overall mechanical and electrical components of the heat exchanger 10 are extremely simple, and in a manual mode of operation in the absence of any type of sensing devices, the heat exchanger 10 is virtually failure-proof during its operation in the heat-augmenting mode since the only "working" parts or components are the heat source 70 and the compressor 50.

As was noted earlier, the condensation which is formed in the upper chamber portion 30 is highly beneficial and, just as importantly, the location of the electrical circuit (FIG. 5) or the components thereof in the chamber 25 prevents the circuitry from being adversely affected by such condensation with, of course, any excess condensation which collects in the pan 38 being drained to the exterior of the housing 11 in the manner readily apparent from FIG. 3.

Finally, due to the arrangement of the components 50, 60, 70 and 80 in the associated chambers, the sound level of the machine is extremely low, and though the arrangement of parts illustrated in the drawings is that preferred, modifications thereto are considered to be within the scope of this invention. For example, the blower 80 may be positioned in the chamber 25 beneath the compressor 50 to increase the efficiency during the summer or cooling mode of operation by drawing air through the vents 23 and the opening (unnumbered) at the top of the chamber 25 over the compressor 50, and into the lower chamber portion 31. Alternately, the same results can be achieved simply by reversing the direction of the rotation of the fan motor of the blower 80.

From the standpoint of new-home or new-building installations, it should be noted that since the heat exchanger 10 is the only unit necessary for all extremes of heating and cooling, any new house, office building or the like would not rquire a chimney, an associated flue, etc. Furthermore, though the heat exchanger 10 has been described thus far relative to being positioned outside of a building which is to be heated and/or cooled, the same may be positioned within the building so long as appropriate duct work is provided between the heat exchanger 10 and exterior ambient air. In the latter case, a chimney, flue or the like remains unnecessary because the amount of heat given off by the flames F is extremely small and is in fact less than that of a conventional home gas clothes dryer which, in most jurisdictions, need not be vented to atmosphere. However, should a code of a particular jurisdiction require the venting of gases, such would be a simple and inexpensive proposition since virtually all of the heat from the flames F is absorbed in the heat-augmenting mode and, thus, the gases which might necessarily have to be vented from the interior of the building to atmosphere would be cold, and the venting duct work would either not require heat-installation or the latter would be extremely minimal.

Figure 5:
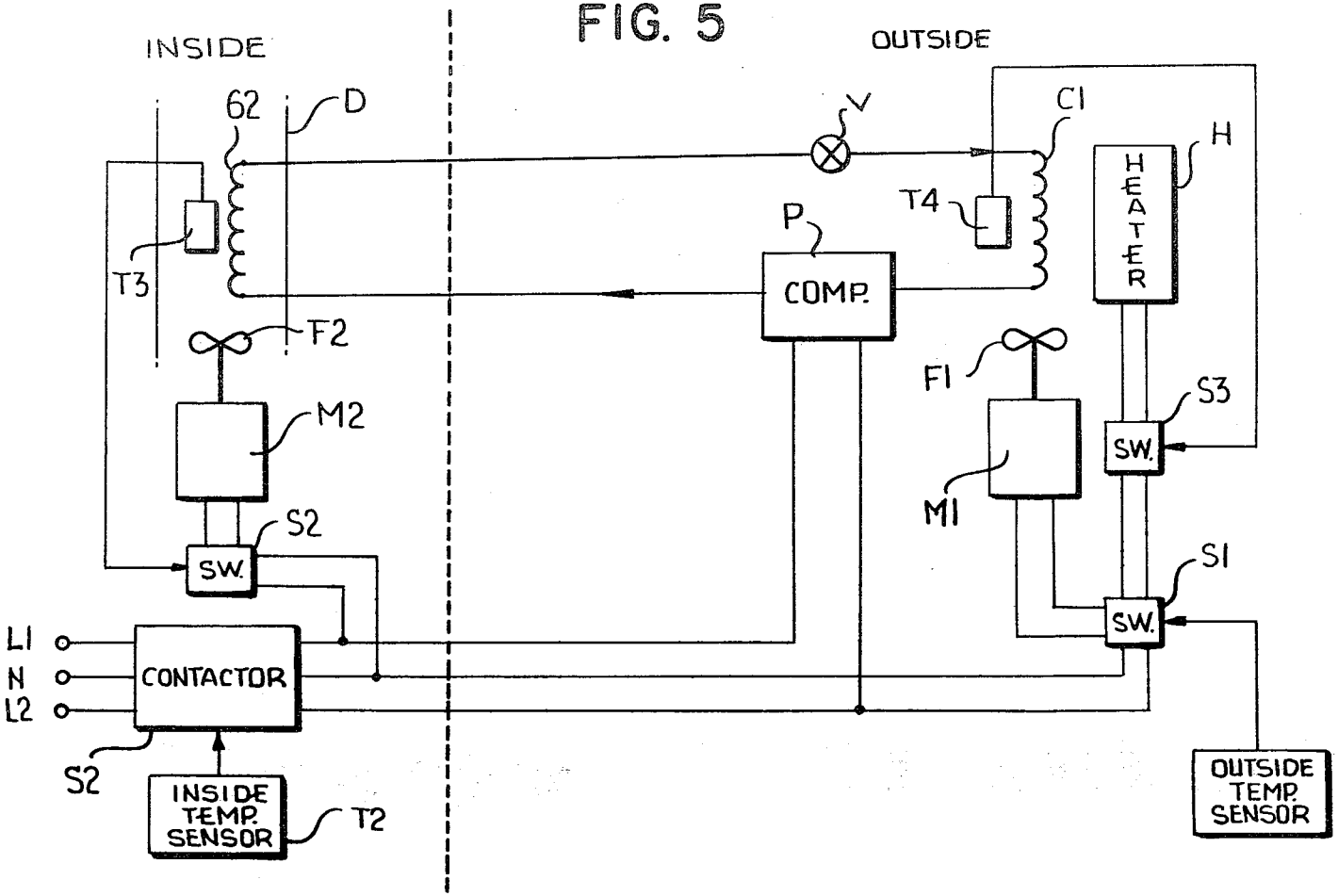
FIG. 5 is a schematic view illustrating certain principles of this invention.

FIG. 5 represents, in simplified schematic fashion, a basic relationship of this invention. As shown, a conventional heat pump arrangement (in heating mode) includes an evaporating coil C1 located outside the space to be heated, a fan F1 and motor M1 therefor adapted to convey ambient outside air in heat-exchange relation through or past the evaporating coil C1 to cause evaporation of the refrigerant therein, a compressor P for reconverting the evaporated refringerant to heated, liquid phase, the heating coil C2 located within the heat ducting system D, the expansion valve V for reducing the pressure of the cooled liquid phase, and the forced air fan F2 with motor M2 for circulating air within the ducting system and the interior space to be heated.

As is well known, the efficiency of the heating mode of such a system depends non-linearly and directly upon the outside air temperature. Dependent upon the system as a whole, inclusive of the type of refrigerant used, the efficiency becomes so low at some predetermined outside temperature that it can no longer supply the heating required. For that and other reasons, the ducting system D will include supplemental heaters, usually electric, to supplement or to supplant the heat extracted from the outside air by the heat pump. Normally, the supplemental heaters are automatically called upon whenever the inside temperature thermostat indicates that insufficient heat is being supplied by the heat pump.

In many areas, the outside air temperature falls to such low values sufficiently often as requires utilization of the supplemental heater for protracted periods, with the attendant increase in cost to the consumer for each BTU delivered. It would, therefore, be of significant advantage to the consumer, as well as the energy supplier, to increase the efficiency of the heat pump at low ambient temperature conditions and thereby minimize utilization of the supplemental heaters.

Surprisingly, it has been found that this can be done by shutting off the outside air circulation fan and supplying sufficient augmenting heat to the evaporating coil to complete the cycle by assuring vaporization of the refrigerant in the coil C1. In the arrangement illustrated, this is effected automatically by means of the outside temperature sensor which controls the switch S1. In normal operation, when the inside thermostat T2 demands heat and thus energizes the conventional contactor S2, power from the lines L1, L2 and N energize the motor M1 and the compressor P and, through the switch S2, the motor M2. The switch S2 is normally open but is closed by the inside coil temperature sensor T3 when the sensor T3 detects tat the temperature of the inside coil C2 has reached a sufficient temperature (e.g., 120° F.) to preclude an uncomfortable draft. When the sensor T1 actuates the switch S1, power is cut-off to the motor M1 to terminate the normal air circulation past the coil C1. At the same time, the switch S1 switches power to the heater H, thereby providing the augmenting heat to the coil C1. Typically, for best results the sensor T1 is set to switch over to augmenting heat in response to an ambient air temperature which has dropped to within the range of about 32°–38° F. Below this switching temperature, the heat pump system, with augmenting heat, will be operative upon demand by the inside thermostat T2 in exactly the same fashion as before.

A further switch S3 is provided in the control to the heater H and this switch is controlled by the temperature sensor T4 to cut-off the heater H when the temperature of the outside coil reaches a predetermined value (e.g., 70° F.). In this way, the augmenting heat supplied by the heater H is limited to a quantity which is just sufficient to assure high efficiency of the heat pump system.

The heater H, of course, may take any form dependent upon local conditions. For example, in areas where gas heat is economical, the heater H may be a conventional automatic-ignition gas burner assembly. In any event, the augmenting heat is supplied in controlled quantity to the evaporating or outside coil, the amount of heat supplied being such that the cost of the energy so consumed is more than offset by the increase in efficiency realized by the heat pump system. Obviously, the best decrease in net operating cost will be achieved by employing the most economical source of heat at the heater H. In many areas this will indicate the use of gas heat although it is not essential in any event to use the least expensive form of available heat energy in order to achieve significant cost saving due to the heat augmenting mode of operation. It is essential only that the controlled amount of heat supplied as augmenting heat be less costly than it would be to provide supplemental heat to the system (in the least expensive way available)

in that amount equal to the gain achieved by the heat pump system due to the increased efficiency thereof attained by the augmenting heat. Stated otherwise, the increased heat output of the heat pump system caused by its efficiency increase due to heat augmentation must be greater than the heat input to the heater H, and this is easily accomplished in any practical case by controlling the amount of energy consumed by the heater H to raise the efficiency of the heat pump system at least approximately to optimum values. Clearly, an optimum value will depend upon a number of factors including the inside temperature demand, the ambient temperature, the size or capacity of the heat pump system and the heat loss characteristics of the heated space under prevailing conditions. Although the method herein is intended to encompass conditions in which the rate of heat supplied by the heater H is varied to optimize the system under changing conditions, a simple and practical system such as is shown in FIG. 5 and wherein the rate of heat input to the coil C1 by the heater H is such as to maintain the average temperature of the coil C1 well above the ambient air temperature but not greater than about 70° F. whenever the ambient air temperature is less than the value set for the heat augmenting mode (e.g., 32°–38° F.). In practical terms, the rate of heater H input will be relatively low so that an efficient heating of the coil C1 is effected and minimal heat loss to ambient atmosphere occurs.

What is claimed is:

1. In a heat pump which comprises an inside heat-rejecting means for providing a source to heat an interior space to a selected personal comfort temperature, means for circulating a heat-absorbing fluid in heat-absorbing flow relation to said heat-rejecting means to cool a refrigerant therein, heat-absorbing means, a compressor having an inlet connected to said heat-absorbing means and an outlet connected to said inside heat-rejecting means, conduit means for returning refrigerant from said inside heat-rejecting means to said heat-absorbing means, means for driving said compressor, heat-generating means constituting the sole source of heat for said heat-absorbing means for generating a quantity of heat immediately adjacent said heat-absorbing means which is essentially totally absorbed by the refrigerant in said heat-absorbing means, the quantity of heat generated by said heat-generating means being in amount sufficient to enable the heat-rejecting means to heat the interior space to said selected personal comfort temperature without requiring forced ambient air circulation through said heat-absorbing means, said heat-generating means being disposed generally contiguous and below said heat-absorbing means, said heat-absorbing means being an outdoor coil defining a substantially enclosed chamber, said heat-generating means developing an open flame for directly heating the refrigerant during the passage thereof from an inlet of said outdoor coil to an outlet of said outdoor coil, and said open flame being directed upwardly and substantially entirely into said chamber.

2. The heat pump as defined in claim 1 wherein said heat-rejecting means and heat-absorbing means are the sole heat exchangers of the heat pump.

3. The heat pump as defined in claim 1 wherein the outdoor coil is of an "A-coil" configuration having a pair of legs, and the heat-generating means is disposed generally between and below said legs.

4. The heat pump as defined in claim 3 including means for closing said "A-coil" at a top portion thereof.

* * * * *